US008919561B2

(12) United States Patent
Boisseau

(10) Patent No.: US 8,919,561 B2
(45) Date of Patent: Dec. 30, 2014

(54) CONTAINER FOR THE MANAGEMENT OF PHARMACY PRESCRIPTIONS, CARES AND SERVICES

(71) Applicant: Jean-François Boisseau, Lachute (CA)

(72) Inventor: Jean-François Boisseau, Lachute (CA)

(73) Assignee: Cogestor, Inc., Lachute, Quebec (CA)

( * ) Notice: Subject to any disclaimer, the term of this patent is extended or adjusted under 35 U.S.C. 154(b) by 0 days.

(21) Appl. No.: 13/760,377

(22) Filed: Feb. 6, 2013

(65) Prior Publication Data

US 2013/0140212 A1 Jun. 6, 2013

Related U.S. Application Data

(63) Continuation of application No. PCT/CA2011/000929, filed on Aug. 16, 2011.

(30) Foreign Application Priority Data

Aug. 19, 2010 (CA) ..... 2712624

(51) Int. Cl.

| | |
|---|---|
| ***B65D 83/04*** | (2006.01) |
| ***B65D 85/00*** | (2006.01) |
| ***G09F 3/00*** | (2006.01) |
| ***A61J 1/14*** | (2006.01) |

(52) U.S. Cl.

CPC ..... *A61J 1/14* (2013.01)
USPC ..... 206/534; 40/312; 206/232; 206/425

(58) Field of Classification Search

USPC ..... 206/232, 425, 534, 557–565, 570–572, 206/540; 40/312; 220/554
See application file for complete search history.

(56) References Cited

U.S. PATENT DOCUMENTS

| | | | | |
|---|---|---|---|---|
| 4,227,615 | A * | 10/1980 | Flick | 206/540 |
| 4,867,315 | A * | 9/1989 | Baldwin | 206/558 |
| 4,890,741 | A * | 1/1990 | Edelstein | 206/534 |
| 5,662,239 | A | 9/1997 | Heuvelman | |
| 5,890,589 | A * | 4/1999 | Lorens | 206/232 |
| 6,971,522 | B2 * | 12/2005 | Yuyama et al. | 206/538 |
| 7,353,939 | B2 * | 4/2008 | Coe et al. | 206/232 |
| 7,395,623 | B2 * | 7/2008 | Park et al. | 40/312 |
| 7,942,451 | B2 * | 5/2011 | Adler | 206/232 |
| 8,025,314 | B2 * | 9/2011 | Adler | 206/232 |
| 2004/0050750 | A1 * | 3/2004 | Hannan et al. | 206/570 |
| 2005/0173290 | A1 | 8/2005 | Yuyama et al. | |

FOREIGN PATENT DOCUMENTS

CA 2486361 A1 3/2002

OTHER PUBLICATIONS

International Search Report for International Application No. PCT/CA2011/000929 mailed Nov. 2, 2011.
Written Opinion for International Application No. PCT/CA2011/000929 mailed Nov. 2, 2011.

* cited by examiner

*Primary Examiner* — Bryon Gehman
(74) *Attorney, Agent, or Firm* — Myers Wolin, LLC

(57) ABSTRACT

A container for managing pharmacy prescription, care and/or service includes a bottom, a peripheral wall extending from the bottom, a secondary wall mounted to the peripheral wall to define a document-receiving compartment; and an information-receiving card mounted to the peripheral wall. The information-receiving card is positionable in either one of an upright position and a tilted position and allows receiving directly thereon or indirectly via cardboard card information that characterizes the pharmaceutical prescription, care and service.

23 Claims, 8 Drawing Sheets

CONTAINER FOR THE MANAGEMENT OF PHARMACY PRESCRIPTIONS, CARES AND SERVICES

CROSS-REFERENCE TO RELATED APPLICATION

This application is a continuation under 35 USC 120 of International Application PCT/CA2011/000929, filed Aug. 16, 2011, and claims priority under 35 USC 119 to Canadian Patent Application No. 2,712,624, filed Aug. 19, 2010, the contents of each which are incorporated herein by reference.

BACKGROUND

Pharmaceutical care services that are provided in pharmacy community settings involve many actors, including the pharmacist, technicians and clerk.

The pharmacist is involved typically in the verification of the drug distribution process, the analysis of patient medication profiles of the patients, including identifying potential drug or condition interactions checking for drug compatibility and contraindication. Also, the pharmacist is called to give counseling to patient about their medication and advices on general health topics to the patients.

The technician typically receives phone orders, welcome patients arriving at the laboratory, computes the prescriptions and other patient-related information in the pharmacy software (preparation of the prescription labels, receipts, etc.), works at the cash register, manages drug supplies, makes conditioning of medication, etc.

The clerk typically works at the cash, but may also help the technician.

The pharmaceutical care and services are carried out following the assignment of specific tasks to each actor in the laboratory which acts and interacts within a logical and sequential activity workflow.

With reference to FIG. 1, a typical pharmacy laboratory can be seen as a production line, including a plurality of areas, which allows the pharmaceutical care delivery process (from left to right in FIG. 1).

A Typical Laboratory Includes:

- a reception, wherein a technician defines the pharmaceutical care or service to the patient/client. In addition to requests from on-site clients, pharmaceutical care requests are received over the phone. This includes the determination of prescription path and handling priority. Possibilities of path include mail or courier delivery and immediate or later pick-up by the client. A container, usually in the form of a tray is then selected by the technician, wherein the color of the tray often allows indicating the priority/path of the pharmaceutical care;
- a production terminal, in the form of a computer usually connected to a remote server, allows the technician to create an indentifying label and invoice and insurance receipts. During this step, a series of pharmaceutical care characteristics are defined with regards to the drugs and/or professional acts to be performed by the pharmacist. For example, indications regarding any specific request by the client or insurer, for example, are written on a Post-It™ or directly onto the label;
- a conditioning area, wherein the prescription labels are inserted in empty vial and the medications are counted or measured. At this step, further information can be provided, for example on a Post-It™ or else. Examples of such further information include prescription storing instructions, any invoicing specification, etc. Different identification means are currently used by pharmaceutical professionals and technicians as reminders for a future step or for another actor. Such other identification means are for example colored clips;
- a verification terminal, wherein the pharmacist verifies the content of the tray, including the prescription vial or another medication container and its label. In this step, the pharmacist also considers any other document included in the basket. The pharmacist also proceeds with a pharmaceutical analyze of the client file before providing any counseling at . . .

. . . the consultation area;

a cash for invoicing the client; and

- a confidential counseling/consultation area, wherein more elaborate, delicate and/or complex care or advices are provided by the pharmacist.

As can be seen from the above, the community pharmaceutical practice results in concrete and abstract matter, including the actual prescription medication, expert advices, pharmaceutical case analyses, etc.

Following the above, one can see that numerous ordered information and pharmaceutical care characteristics are provided from one actor to the other and to the client and from one area to the next within the laboratory.

In a typical pharmacy laboratory, wherein a simple basket or container is used to receive and convey all the above mentioned information and characteristic of the pharmaceutical care, one can see how such basic container shows many limitations and often leads i) to a waste of time in searching for the information, ii) misunderstandings and confusion in actor dealing with the information, iii) lost of some information and iv) difficulty in defining and quantifying of requests, etc.

DETAILED DESCRIPTION

Figure 1:
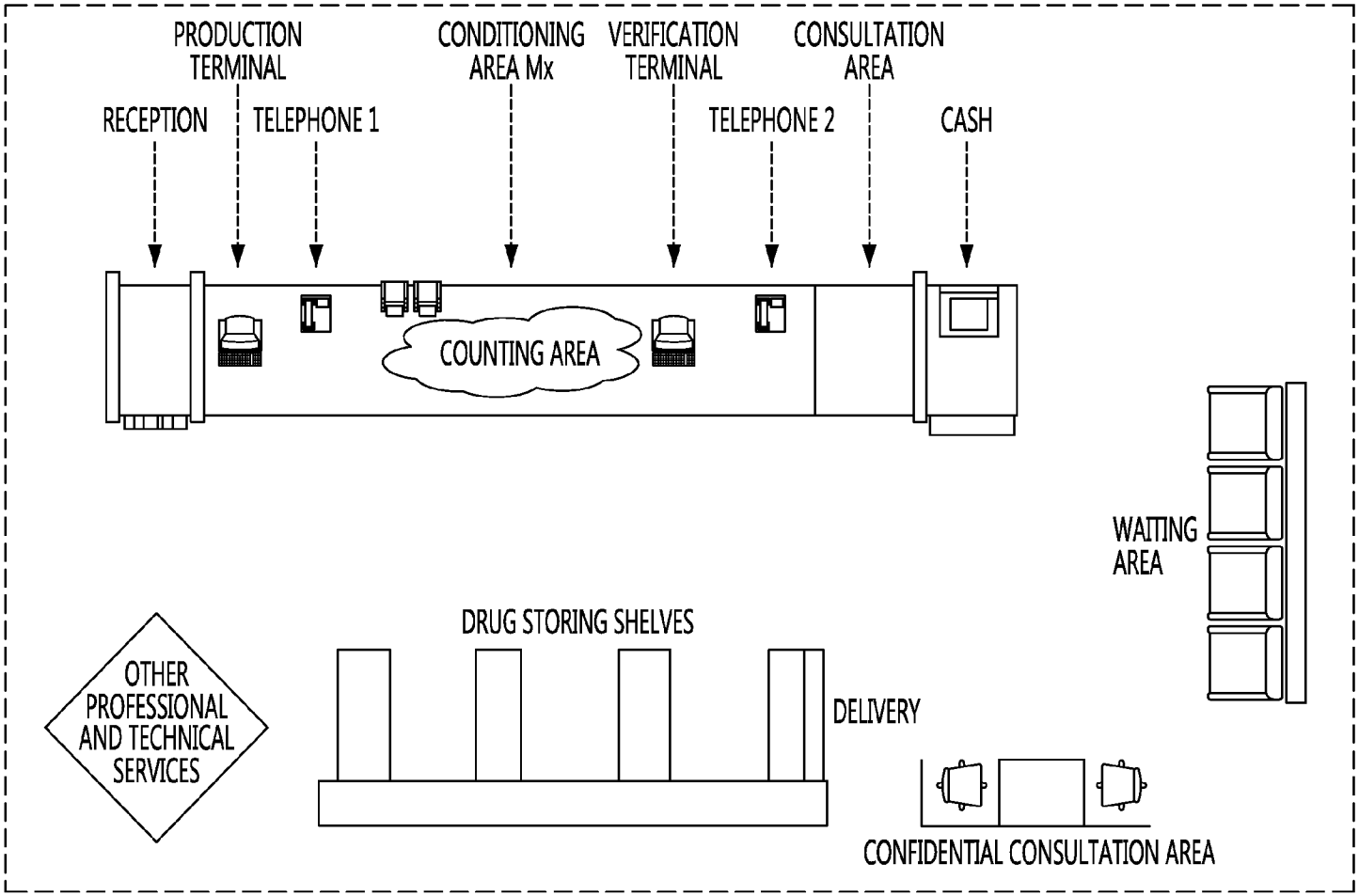
FIG. 1 is a top plan schematic view of a typical community pharmacy laboratory.

An object of the present invention is to provide an improved container for the management of pharmacy prescriptions.

In accordance with an illustrative embodiment, there is provided a container for the management of a pharmaceutical care or product comprising:

a bottom;

a peripheral wall extending from said bottom;

a secondary wall mounted to the peripheral wall so as to define a document-receiving compartment between the peripheral wall and the secondary wall for receiving at least one document; and an information-receiving card mounted to the peripheral wall for receiving and displaying information thereon.

Other objects, advantages and features will become more apparent upon reading of the following non-restrictive description of illustrative embodiments thereof, given by way of example only with reference to the accompanying drawings.

In the following description, similar features in the drawings have been given similar reference numerals, and in order not to weigh down the figures, some elements are not referred to in some figures if they were already identified in a precedent figure.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, unrecited elements.

The expressions "pharmaceutical care" and "pharmaceutical service" should be construed broadly as including any charged or free act that occurs directly or indirectly in relation to a costumer. Such an act can occur on site or remotely with regards to the care and service provided and can be done by a health care professional, technician, clerk, cashier, or else. For concision purposes, the expression "pharmaceutical care" will be used herein to also include the meaning of "pharmaceutical prescription".

The expressions customer, client and patient are used herein to refer to any person requesting and/or receiving the pharmaceutical care or service.

Figure 2A:
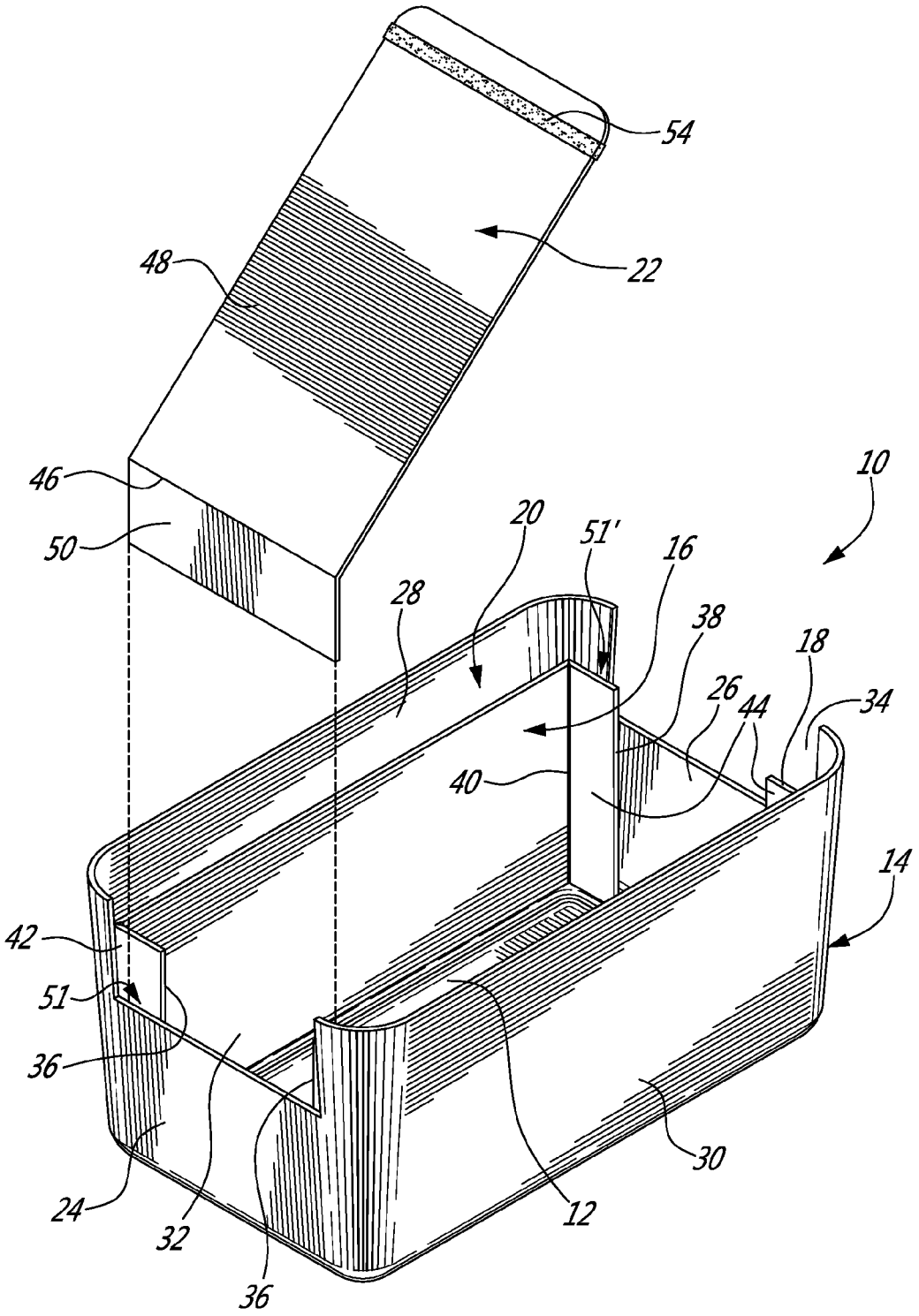
FIG. 2A is a perspective view of a first embodiment of a container for the management of pharmacy prescriptions; the container being showed with its information-receiving card removed therefrom.

A container 10 for the management of pharmacy prescriptions according to a first embodiment is illustrated in FIG. 2A.

The container 10 comprises a bottom 12, a peripheral wall 14 extending from the bottom 12, two secondary walls 16 and 18, respectively defining first and second document-receiving compartments 20 (only one shown), and an information-receiving card 22 for removably mounting to the container 10 as will be explained hereinbelow in more detail.

According to the first embodiment, the bottom 12 and the cross section of the peripheral wall 14 are generally rectangular.

The peripheral wall 14 is defined by opposite front and back longitudinal end walls 24 and 26 and two opposite lateral walls 28 and 30. The edges between each lateral wall 28 and 30 and the longitudinal end walls 24 and 26 are rounded. According to another embodiment (not shown), these edges are acute.

The top edges of the front and back walls 24 and 26 include respective rectangular cuts 32 and 34, yielding surbased walls 24 and 26 relative to the lateral walls 28 and 30.

Each of the secondary walls 16 and 18 is generally rectangular in shape and has longitudinal ends 36 and 38. Each of the secondary walls 16 and 18 include two transversal linear thinner portion 40 located near respective longitudinal ends 36 and 38 (only one shown). These portions are weakness lines 40 defining front and back pivotable wings 42 and 44. The secondary walls 16 and 18 are so dimensioned and the weakness lines 40 so positioned that the walls 16 and 18 extend generally along respective lateral walls 28 and 30 and the weakness lines 40, that act as hinges, are generally aligned along the edges.

The secondary walls 16 and 18 are secured to the respective lateral walls 28 and 30 along the bottom edge thereof using glue, plastic welding, fasteners or else, so as to allow biasing the secondary wall 16 or 18 from the lateral wall 28 or 30 for inserting documents therebetween without removing the secondary wall 28 and 30. The secondary walls 16 and 18 define the first and second document-receiving compartments 20 (only one shown) with respective lateral walls 28 and 30.

Any type of printed document can be inserted in the document-receiving compartments 20. Example of such documents include a prescription, receipt, advice and health booklet or leaflet, memo, Post-It™, insurance card, health care card, etc.

Figure 3:
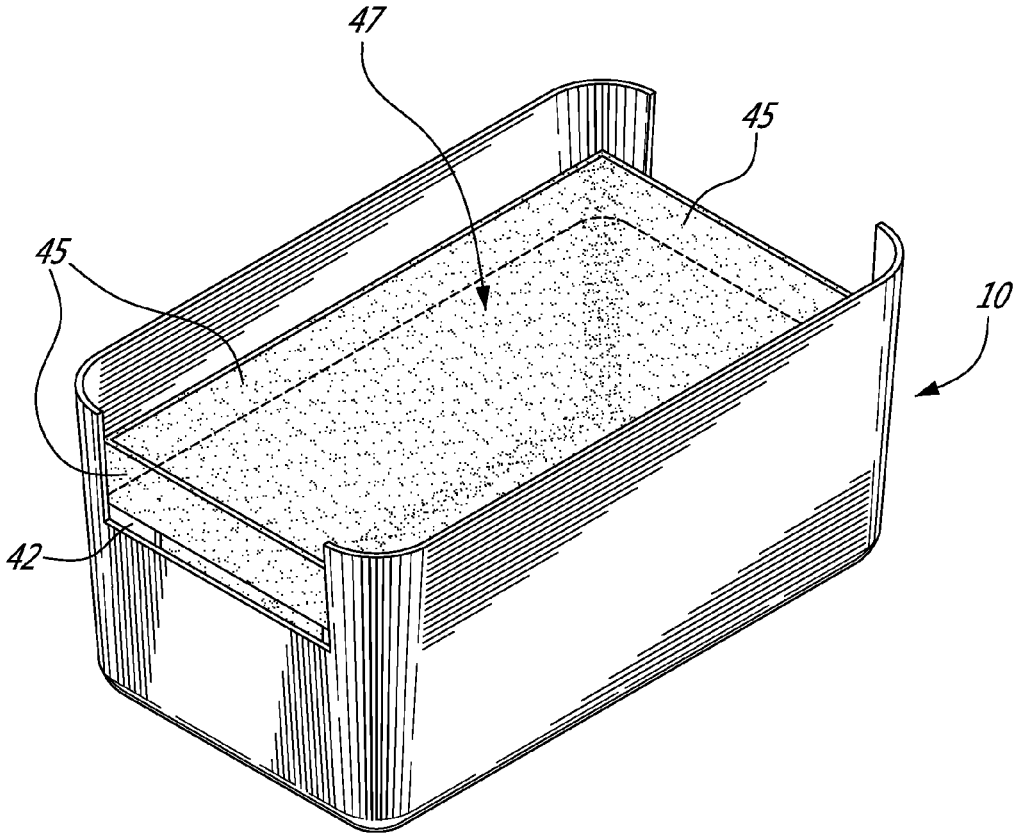
FIG. 3 is a perspective view similar to FIG. 2A, showing the container having a bag therein.

As illustrated in FIG. 3, the secondary walls 16 and 18, including the wings 42 and 44, further acts as a bag-receiving support, wherein the open top peripheral portion 45 of a bag 47 is inserted between the secondary walls 16 and 18 and the peripheral wall 14 of the container 10. Purposes of the bag 47 will be described hereinbelow in more detail.

The wings 42 and 44 can be pivoted from an unfolded position, wherein the wings 42 and 44 are generally parallel to the respective front and back wall 24 and 26, to a support position, wherein the wings 42 and 44 are folded towards the respective lateral walls 28 and 30 so as to define an acute angle therewith and then to a storage position, wherein the wings 42 and 44 are generally parallel to the respective lateral walls 28 and 30.

Figure 4:
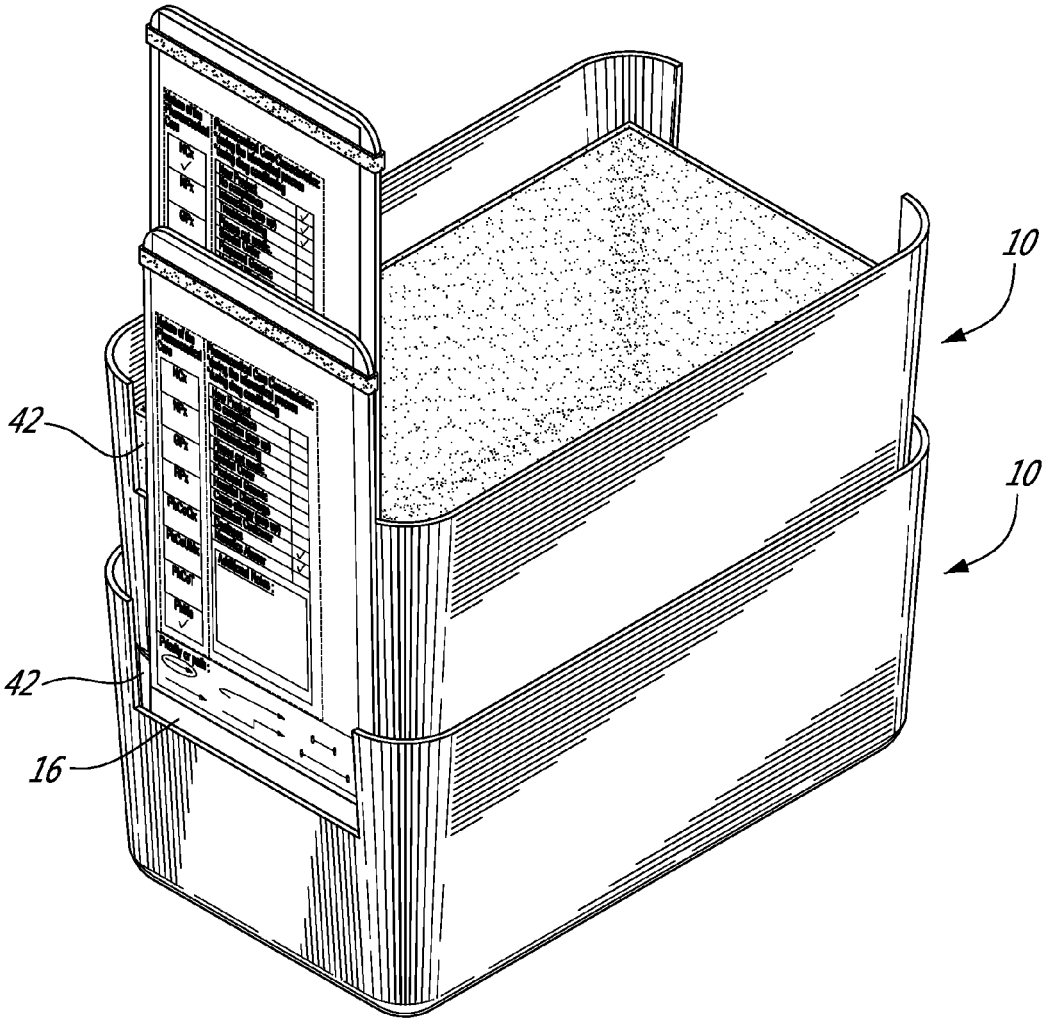
FIG. 4 is a perspective view similar to FIG. 2A, showing a further container inserted in the first container to form a stack.

As can be seen in FIG. 4, when the wings 42 and 44 are in their support position, they act as supports for a second container 10 inserted in the first container 10. In this manner, containers 10 can be stacked in a stable manner. For that purpose, the peripheral wall 14 is tapered along its height towards the bottom 12. According to the first embodiment, each of the walls 14, 16, 24 and 26 defines a 100 degrees angle with the bottom 12.

According to another embodiment, the peripheral wall is not tapered but includes a wide top portion and a narrower bottom portion. The peripheral wall can also be configured so as to be generally perpendicular to the bottom 12. According to further embodiments, the wings 42 and 44 are omitted.

According to still another embodiment, the secondary walls are interconnected.

The bottom 12 is transparent so as to allow inspection of the drug container and pills, cream and/or puffer therein (not shown) in the container 10 from the bottom 12 as will be explained hereinbelow in more detail. The bottom 12 is snap fitted to the peripheral wall 14. For that purpose, the peripheral wall 14 includes a small rim (not shown) extending inwardly perpendicularly from the walls 24 to 30 and that includes a catch (not shown) for locking the bottom 12 to the rim.

The bottom can be made of a scratch-proof or non scratch-proof polymeric material, glass, etc.

According a further embodiment, the bottom is opaque.

According to the first embodiment, the peripheral wall 14 and the secondary walls 16 and 18 are made of a polymeric material and result, for example, from a molding process.

According to the first embodiment, the front, back and lateral walls 24 to 30 are integral and the bottom 12 is assembled thereto. According to another embodiment, the walls 24 to 30 and bottom 12 are all assembled. According to still another embodiment, the peripheral wall 14 and bottom 12 are integral and result, for example, from a molding process.

The information-receiving card 22 is a flat generally rectangular rigid plastic body having a transversal linear thinner portion adjacent one of its longitudinal side edge defining a hinge 46 and separating the card 22 in a support portion 48 and a tab 50.

Figure 2B:
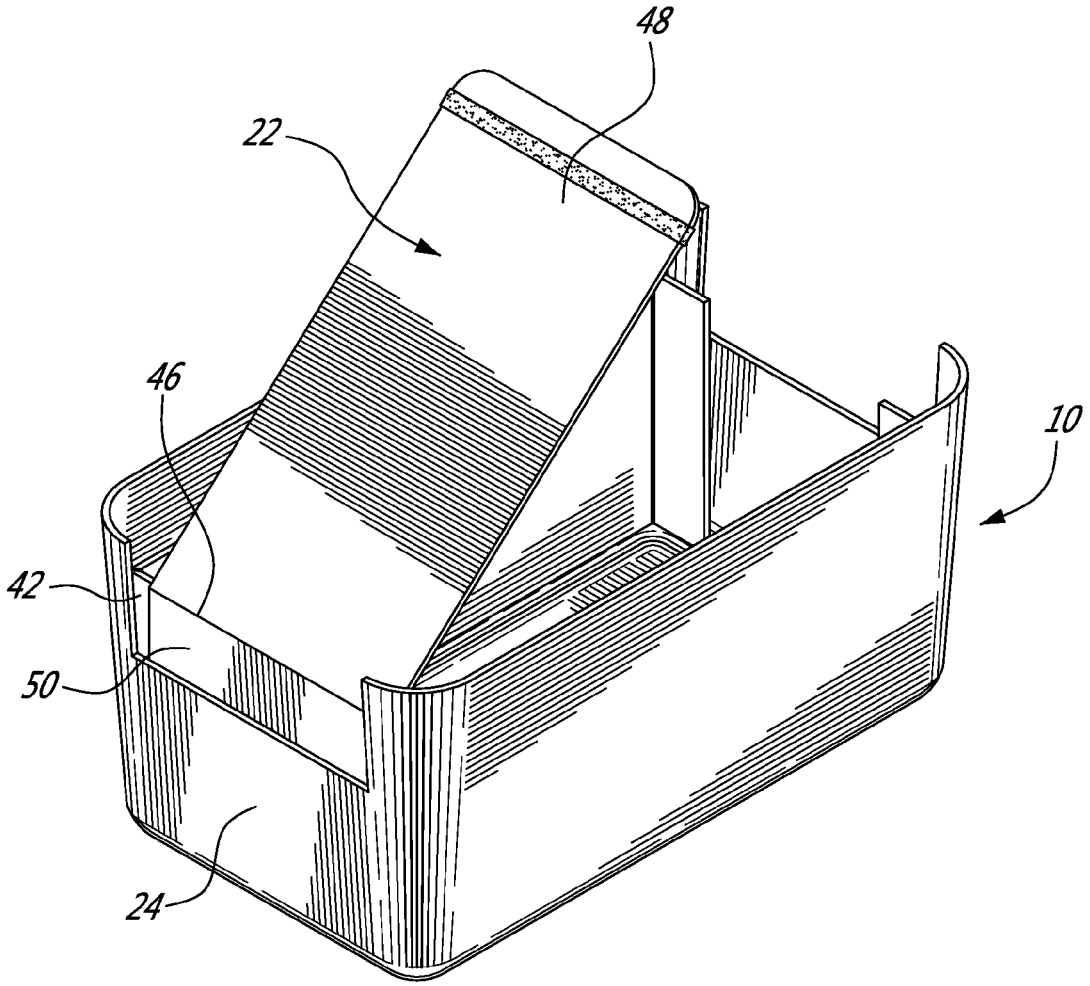
FIG. 2B is a perspective view similar to FIG. 2A, showing the information-receiving card mounted to the container in a tilted position.
Figure 2C:
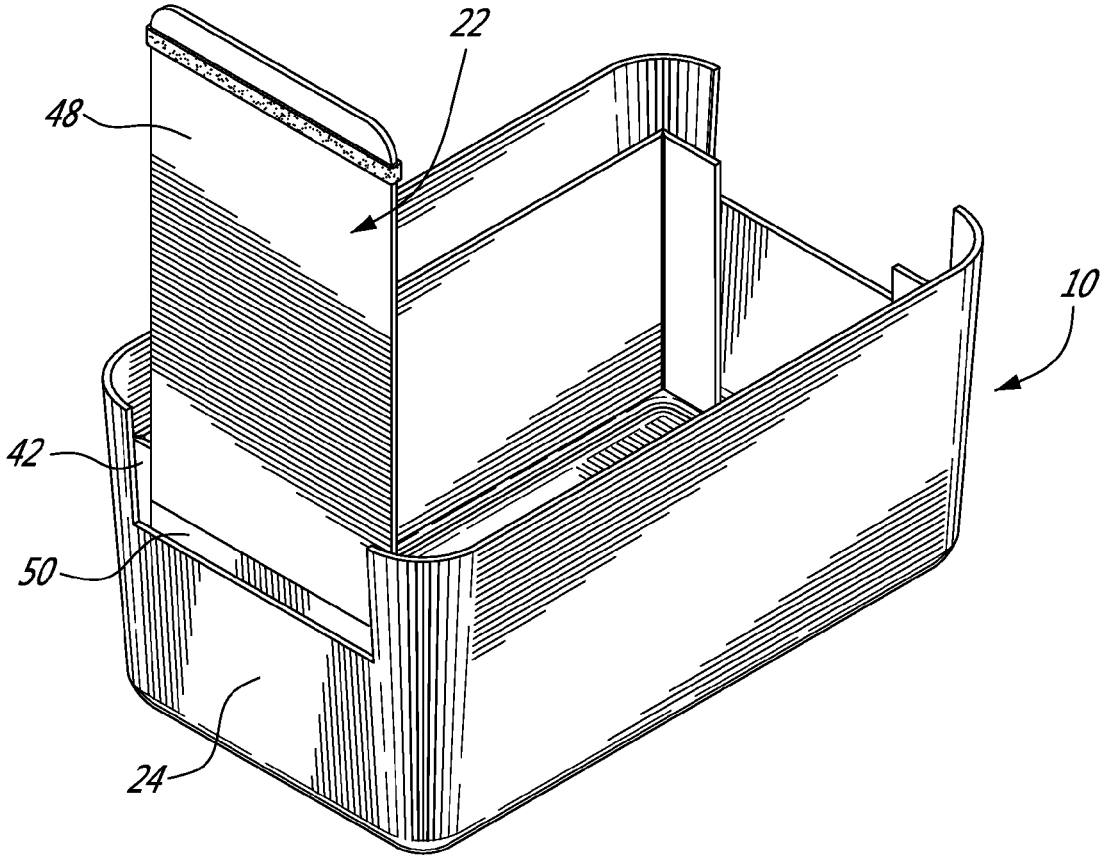
FIG. 2C is a perspective view similar to FIG. 2A, showing the information-receiving card mounted to the container in an upright position.

As can be better seen in FIGS. 2B and 2C, the card 22 cooperates with the container 10 so as to be positioned in a slanted configuration (see FIG. 2B) or in an upright configuration (see FIG. 2C).

The slanted configuration, shown in FIG. 2B, is achieved by inserting only the tab 50 of the card 22 between the slot 51 defined by the front wall 24 of the container 10 and the wings 42, so that the support portion 48 is free to tilt about the hinge 46 towards the inside of the container 10. In this configuration, the tab 50 remains visible in the rectangular cut 32.

The upright configuration of the card 22 results from the insertion of the tab 50 and the hinge 46 in the slot 51, so that the support portion 48 is prevented by the wings 42 from tilting about the hinge 46 towards the inside of the container 10.

The slanted and upright configurations can also be obtained by inserting the card 22 between the wings 44 and the back wall 26 in a similar manner. According to the first embodiment, the slanted configuration of the card 22 yields the support portion 48 free to tilt about the hinge 46 towards the exterior of the container 10. The card 22 can also be inserted between the wings 42 or 44 and the respective wall 24 or 26 so as to be slanted towards the interior or exterior of the container 10.

The card 22 allows receiving information thereon. According to the first embodiment, the card 22 is intended to receive a rectangular cardboard information card 52 having patient and/or care related-information printed thereon.

As can be seen for example in FIG. 2B, the information card 52 is secured to the plastic card 22 using a rubber band 54. According to another embodiment, the back of the card 22 is auto adhesive. Other fastening means can be used to secure the card 52 to the card 22, including a paperclip, a staple, or any other cooperating means provided on both cards 22 and 52.

Figure 5:
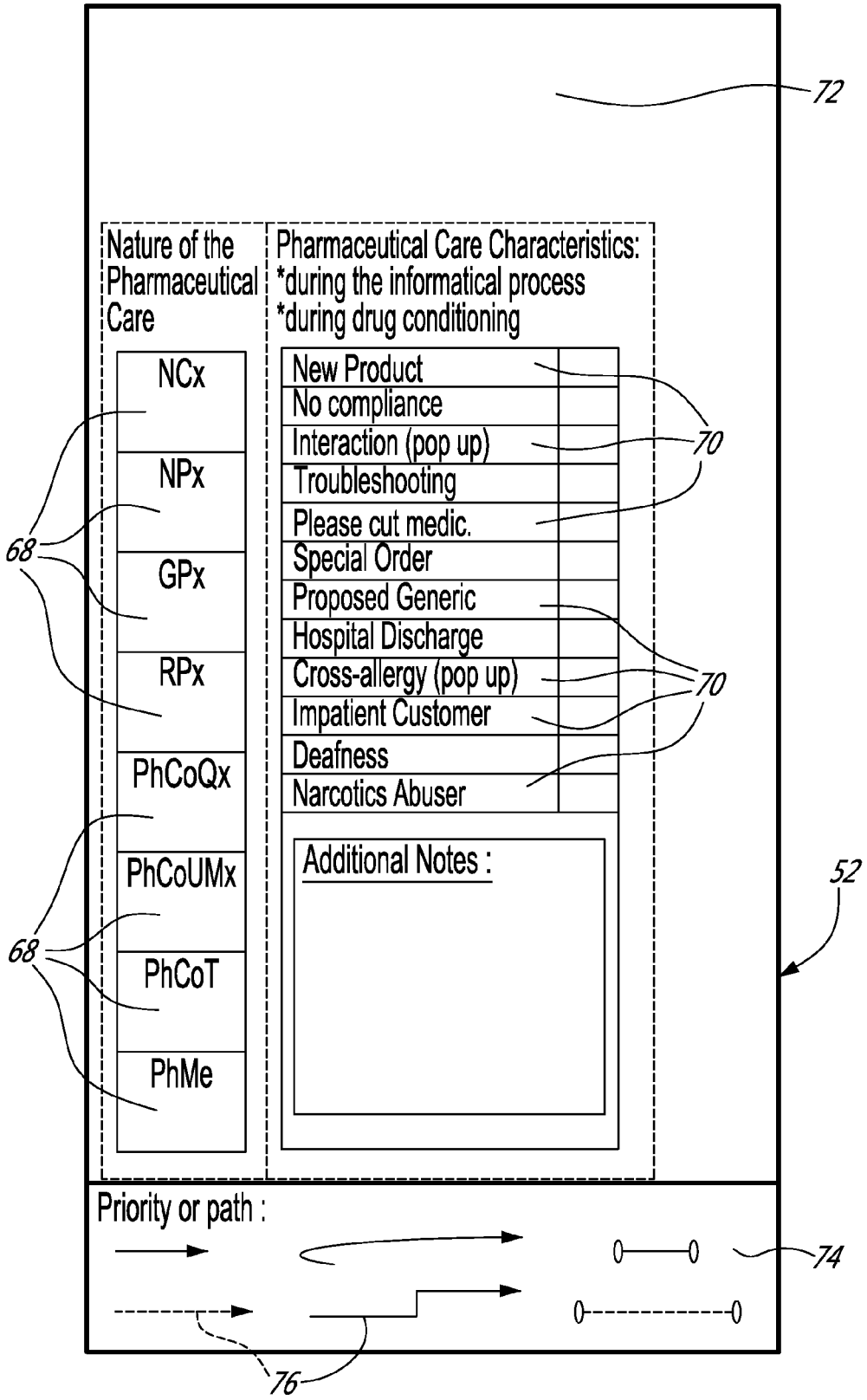
FIG. 5 is a template for inserting information on the information-receiving card from FIG. 2A.

As can be seen in FIG. 5, which shows an example of such a cardboard card 52, the card 52 can act as a roadmap including a template to enter information such as, without limitations the nature or type of the pharmaceutical care, characteristics thereof as obtained during the information gathering process or during drug conditioning, a priority or path, a blank space to enter additional information or characteristics of the care or patient, etc.

The information that is carried by the container 10 allows implementing a predetermined sequence of pharmaceutical care and services. An example of such a sequence broadly includes:

determining the nature of the pharmaceutical care;
determining the container assignments;
characterizing the information;
characterizing the conditioning; and
classifying the container 10.

Considering the above, the card 52 includes first identifiers 68 displayed thereon to help the laboratory actors characterizing the pharmaceutical cares for the client. The identifiers 68 include boxes, each with a short description. The actor allows the user to check the corresponding care to be dispensed to the customer. The choices include: new client (NCx), new prescription (NPx), repeat of prescriptions (RPx); regeneration of an old prescription (GPx), request of health-related or prescription—related advices/counseling (PhCoQx), counseling required with regards to a currently requested prescription (PhCoUMx); advices on health topics or counseling on medication requested via telephone (PhCoT); or telephone message left by the client (PhMe).

The card 52 also includes a second group of identifiers 70, also in the form of check boxes, allowing the user to characterize the informatics process of the prescription and the drug-conditioning process as described hereinabove.

The top portion of the card 52 includes a free space 72 for receiving notes or any other information. Such notes and information are either written directly in the space 72 or through a small piece of paper attached to the card 52 in the space 72 using a clip, through an adhesive or using another fastening means.

Examples of information that can be written in the space 72 include: a note to the effect that the prescribed drug should be stored in a refrigerator, reminder to count the pills twice, etc.

The top portion 72 can also be used to print or write the name of the client, its coordinates, etc.

A color code can be used to further characterize the information displayed in the space 72 so as to further contribute easing the identification and/or recognition of said information. For that purpose, a small colored sticker (not shown) can be affixed in the space 72 or a colored clip can be used to secure a piece of paper (not shown).

According to the illustrated embodiment, the bottom tab 74 is used to identify the priority or path of the pharmaceutical care. In the illustrated example, graphical symbols 76 including lines and arrows are used for such identification. The user then makes his/her selection by marking the corresponding symbol 76. As non-restrictive examples, the symbols 76 correspond to the following path/priority: simple pick-up, complex pick-up, same day pick up, later time pick-up, home delivery, and postal delivery.

According to another embodiment (not shown), the priority or another characteristic of the pharmaceutical care is identified by the color of the card 52 or 22.

Also, the card 52 is not limited to include the information or template shown in FIG. 5. Any other information can be displayed on the card 52 according to any template or form.

According to another embodiment, the card 52 is initially blank and only the information characterizing the current pharmaceutical care is printed on the card 52 using a printer (not shown) or simply hand written thereon.

In addition to the document-receiving compartments 20 and information-receiving card 22, any surface of the container 10, such as the outer surface of the wall 24 under the cut 32, or the card 22 or 52 can be used to display advertisement, client, care or prescription-related information. Such additional information can be printed on a paper or plastic support or directly onto the container surface. The information support can then be secured to the surface via a clip, adhesive material, etc.

Any information displayed on the container or received therein can be different than the example presented hereinabove or presented according to another template.

According to another embodiment (not shown), the patient and/or prescription related information is directly printed onto the card 22, which is then made of paper, including thermal paper, or cardboard. The card 22 or 52 can also be in the form of a thin portable electronic device (not shown) that can be, for example, further coupled wirelessly to a computer, a server or another electronic device including or having access to patient and/or prescription related information.

As will now become more apparent to a person skilled in the art of pharmaceutical care and service, the container 10 allows receiving the prescription drug and also receiving, managing and displaying any document and information characterizing the care or service, including the actual prescription drug. The container 10 acts as a contributions space, from and for the actors, that evolves during its moving along the prescription preparation process and throughout the area defined with reference to FIG. 1. The container 10 allows the different actors in the laboratory to easily and rapidly found information placed on or in the container 10 by another actor.

Further characteristics, features and functionality of the container 10 will become more apparent upon reading the following exemplified description of its use.

A technician at the reception picks a container 10 and a transparent plastic bag 47 and hangs the bag 47 to the bag-receiving supports of the container 10 as illustrated in FIG. 3. According to another embodiment of the present invention, the bag 47 is pre-inserted in the container 10.

The technician then picks a card 52 and writes the name of the client, his/her birthday and/or his/her coordinates on the top blank portion 72 and identifies on the card 52 the nature of the pharmaceutical care requested by the client using the appropriate box 68. The identification in the box is in the form of a number quantifying the care. For example, the technician writes the number '2' in the NPx box to inform the other actors that will play a role in the pharmaceutical care or to remind herself that the care includes two (2) new prescriptions.

According to the first embodiment, the card 52 is selected among a plurality of different colored cards (not shown) so that its color is indicative of the priority and/or path assigned to the pharmaceutical care. The priority and/or path are further identified using one of the symbols 76 displayed on the tab 74 as described hereinabove with reference to the FIG. 5.

As mentioned hereinabove, the assignment or care request may come from a client present in the pharmacy or over the phone.

Once the information is written on the card 52, the technician then picks an information-receiving card 22 and attached the card 52 thereon using for example a rubber band 54 so that the tab 74 of the card 52 is registered with the tab 50 of the card 22. Prior to its use, the card is advantageously stored in the bottom 12 of the container 10 or in one of the two (2) document-receiving compartments 20 but can be stored separately from the container 10.

At this point, the card 22 is positioned at the front of the container 10, in the slot 51 so that the card 22 holds in the upright configuration, as described with reference to FIG. 2C.

Before inserting drug vials or any other drug containers (not shown) in the container 10, the card 22 with the card 52 attached thereon is removed from the slot 51 and inserted in the slot 51' defined by the back wall 26 of the container 10 and the wings 42, freeing the front access to the container 10.

In the case where the pharmaceutical care includes a new prescription, this prescription (not shown) from the doctor or from another health care professional is inserted for example in the front side of the left document-receiving compartments 20. This document can then be readily found and consulted by any actor in the laboratory.

Any empty used vial or other medication container returned by the client and that can be recycled is placed in the bottom 12 of the container 10.

At any step along the workflow of the processing chain, whenever there is more than one container 10, the containers are positioned in one or more stacks as shown in FIG. 4. When a plurality of containers 10 is stacked, the cards 22 are positioned in their respective slot so as to be upright. In this position, the cards do not interfere with the stacking and the information on the card is readily available and can be read easily.

Following the first two steps described hereinabove, i.e. 1) the definition of the pharmaceutical care and 2) the determination of a priority/path using the card 52, the technician then begins the computing of the prescription for the pharmaceutical care as briefly described hereinabove and as it is believed to be well known in the art.

Using the card 52 and the prescription note in the information-receiving compartment 20 as references, the technician creates a new client file using the terminal or accesses it in the case of a returning client. Using the client information and the prescription note, the technician uses the production terminal (see FIG. 1), or any other device allowing access to the client file, to use the client-related information to prepare the label and the invoice and insurance receipts.

The label and the invoice and insurance receipts as well as any other document or card are stored in either one or both of the document-receiving compartments 20 according for example to a predetermined classification protocol.

In addition to the label, insurance receipt and invoice, example of documents that can be inserted in the information-receiving compartments include the client insurance and health-care cards, advice leaflets and any other information document.

Then, during the conditioning step, the prescription labels are inserted on or in the vials, the pills are inserted in the vials and the vials are positioned upright into the container 10 and therefore into the bag 47 which is still in the container 10.

It is to be noted that, at any step, the card 52 is readily available to the actors to add or complement information thereon.

The transparent bottom 12 of the container 10 and the transparent bag 47 allow a digital picture of the content of the container 10, including any containers and any accompanying label thereon (both not shown), to be taken from the bottom thereof after the closing of the bag 47 so as to allow the identification of the right pills, puffers, tube of cream, etc. (name and strength). Such a digital picture can then be used by the pharmacist, or by any other authorized actor, to inspect the content of the container 10 and the accuracy of the prescription conditioning.

Since digitalization and storing of images are believed to be well-known in the art, these steps will not be described furtherin for concision purpose. The labeling and classifying of the medication and medication containers (not shown) are also believed to be well-known in the art and, as such, will not be described furtherin. According to some embodiment, the medication container can be positioned and ordered in the container 10 according to predetermined pattern and logic, allowing maximizing their identification in the container, for example in a digital picture thereof.

The picture being digital and stored in a computer or server, the verification of the accuracy of the prescription can be achieved away from the laboratory by any person having access to the picture file. Of course, the client file, or at least the parts thereof relevant to the inspection process, is also made available to the pharmacist doing the inspection, in accordance to the rules and/or protocols of the local pharmaceutical laws and/or practices.

When the pharmacist proceed to the pharmaceutical analysis of a client file, for example at the verification terminal (see on FIG. 1), the card 52 is consulted, and more specifically the information conveyed thereby. Since the pharmaceutical analysis step is believed to be well-known in the art, it will not be described furtherin for concision purposes.

According to the first embodiment, the bag 47 includes tempered-proof closing means, such as a self-adhesive upper rim, allowing indicating any unauthorized opening of the bag 47. Such tempered-proof closing means allows ensuring that the verification by the pharmacist or by another authorized actor of the container's content remains effective until the bag 47 is in the hands of the client. Any other well-known means and/or mechanism can also be used to temper-proof or lock the bag 47. According to another embodiment (not shown), the closing means is not tempered-proof. According to still another embodiment (not shown), the closing means is omitted. In case wherein the pharmaceutical care includes a new prescription, the pharmacist can use any advice or information leaflet left by the technician in the document-receiving compartment 20 to provide recommendations in the consultation area or elsewhere.

Finally, the next step concerns the invoicing of the pharmaceutical care by the technician, clerk or cashier, wherein the documents in the information-receiving compartments that are intended for the client are inserted in a second bag (not shown) along with the bag 47. A conventional plastic bag, typically including the pharmacy logo thereon, can be used as the second bag.

When the pharmaceutical care results from a telephone call and therefore involves a pick up or a delivery at a later time, the content of the container 10, including the prescription vials and any document inserted in the information-receiving compartment, is stored in a plastic bag provided with a handle. This second bag is then hung in storage using for example the handle. During the pick up by the client, all the above-described content is removed from the storage bag and inserted in the conventional plastic bag mentioned hereinabove.

It is to be noted that neither the technician nor the pharmacist are limited to the role assigned in the previous example and each of them or another person can performed anyone of the actions described hereinabove, in respect of the rules/protocols of the local pharmaceutical laws.

According to another embodiment, the documents are positioned in the container 10 using a different classification protocol than the one described hereinabove.

Figure 6:
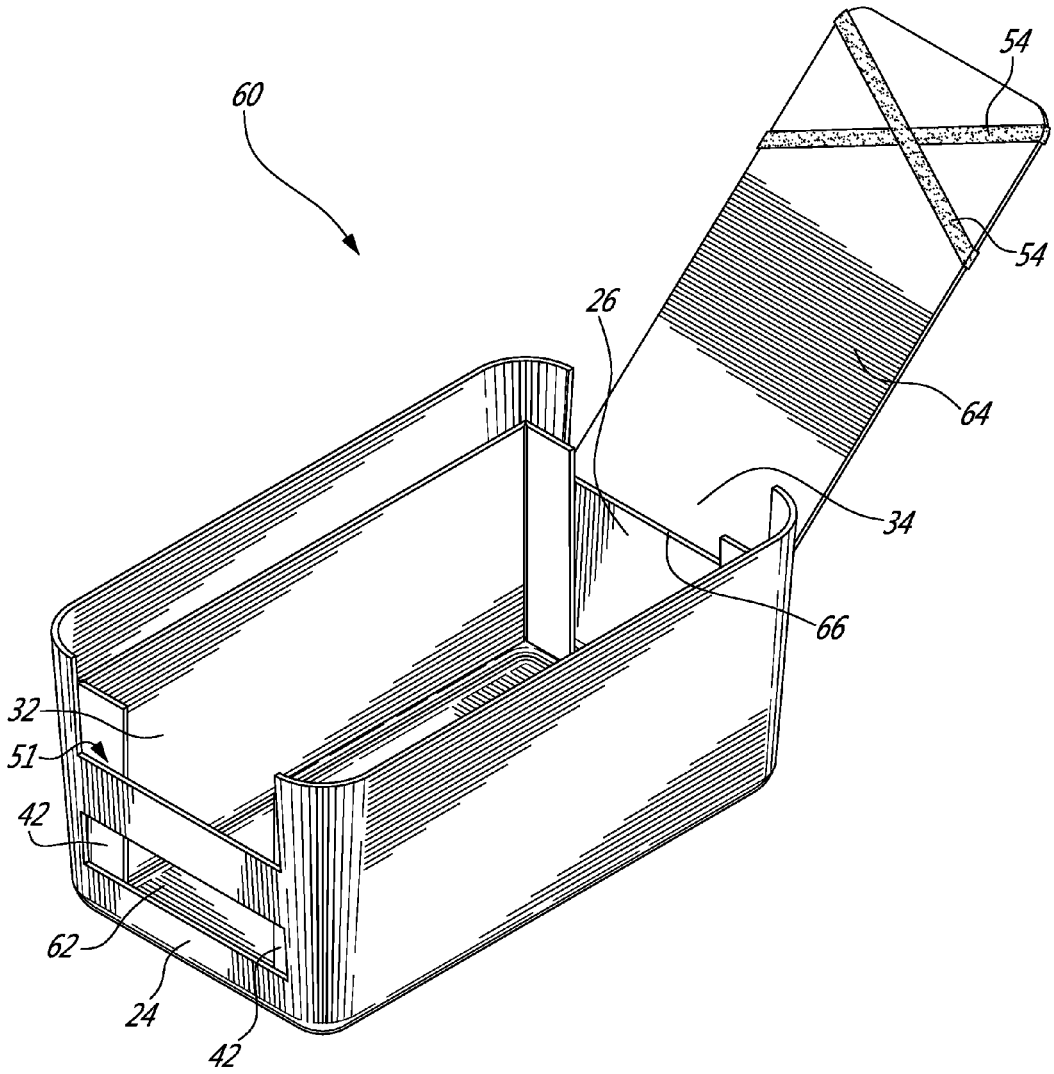
FIG. 6 is a perspective of a second embodiment of a container for the management of pharmacy prescriptions.

A container 60 for the management of pharmacy prescriptions according to a second embodiment will now be described with reference to FIG. 6. Since the container 60 is similar to the container 10, only the differences between the containers 60 and 10 will be described herein for concision purposes.

In addition to the rectangular cuts 32 and 34 in the walls 24 and 26, the front wall 24 includes a rectangular window 62 below the cut 32. The window 62 can be used to display information on a card (not shown) when such card is inserted in the slot 51, or the window can act as a support in combination with the cut 32 or wings 42 to hold a paper or cardboard document (not shown).

The window 62 can further act as a slot to be used for inserting a document or else when a second container 60 is mounted on the first container 60 in a stack arrangement as illustrated in FIG. 4.

The container 60 further includes a tablet 64 integrally mounted to the back wall 26 so as to be tiltable. More specifically, the intersection 66 of the tablet 64 with the top edge of the wall 26 is thinner than at least one of the top portion of the wall 26 and the bottom portion of the tablet 64 allowing repetitive tilting movement of the table 64 relative to the wall 26.

The connection of the tablet 64 to the wall 26 is not limited to the illustrated weak line 66 and can take other form allowing pivotable movement of the tablet 64. For example the tablet 64 can be mounted to the wall 26 via a hinge.

According to another embodiment (not shown), the tablet 64 is fixedly mounted to the wall 26 in an upright or slanted configuration.

One or two rubber bands 54 can be provided to secure documents to the tablet 64. Other means, such as those described with reference to the first embodiment, can be used to secure the information to the card 52. The document can be for example in the form of the card 52.

It is to be noted that many modifications could be made to the containers 10 and 60 described hereinabove and illustrated in the appended drawings. For example:

- the container is not limited to a rectangular shape and can be for example round, oval or irregular;
- the dimension of the container and the proportion of its component, including the information-receiving card, are adapted to the application of the container;
- in case of a container being generally rectangular, such as container 10 or 60, the secondary walls 16 and 18 can be configured so as to have a length shorter that the length of the longitudinal walls 28 and 30;
- the wings 42 and 44 are not limited to be pivotable and can also be omitted;
- the container is not limited to being made entirely or in parts from a polymeric material. Any other rigid material can be used, including cardboard, metal, etc.;
- the cuts 32 and 34 are not limited to a rectangular shape or to be identical in shape and size. The cuts 32 and 34 can be for example elliptic, irregular or else. The cuts 32 and 34 can also be omitted;
- other means than a transparent bottom can be used to help indentifying and/or scanning of the contents of the container. Such means can be in the form of, for example, imprints, markings, RFID (Radio-Frequence Identification) or digital tags, bar codes, etc.;
- in addition to the document-receiving compartment 20 and the card 22, any surface or part of the container 10 can further be used to receive information for display or support. Such information can be written or displayed directly onto the container 10 or attached or fastened thereon using a clip, adhesive paper, etc.;
- the card 22 can be of any shape. Also, a plurality of cards 22 of different colors can also be provided so as to allow the actors to further visually characterized the care/prescription by selecting a card 22 having a color indicative of the specific characterization of the care/prescription;
- the bag 47 can be transparent or opaque and can be made of any suitable material, including polymer, fabric, organic, etc.;
- the container 10 or 60 or bag 47 can be colored so as to further help managing the prescription therein. For example, specific colors can be associated to anyone of the characteristics identified on the card 52; and
- any other characterization of the patient, care, or prescription than those illustrated and/or described herein can be used.

Although the present invention has been described hereinabove by way of illustrated embodiments thereof, it can be modified, without departing from the spirit and nature of the subject invention as defined in the appended claims.

The invention claimed is:

1. An open-top container for the management of a pharmaceutical care comprising:

a bottom;

a peripheral wall extending from said bottom;

a secondary wall mounted to the peripheral wall so as to define a document-receiving compartment between the peripheral wall and the secondary wall for receiving at least one document; and an information-receiving card mounted to the peripheral wall for receiving and displaying information thereon;

wherein the secondary wall further defines with the peripheral wall a slot for receiving the information-receiving card;

wherein the information-receiving card includes a support portion, a tab portion and a hinge allowing movement of the information-receiving card between an upright configuration, wherein the support and tab portions generally lie within a same plane, and a slanted configuration, wherein the support portion is tilted relative to the tab portion; the information-receiving card cooperating with the slot to be moved between the upright and slanted configurations.

2. A container as recited in claim 1, wherein the information-receiving card is removably mounted to the peripheral wall.

3. A container as recited in claim 1, wherein the information-receiving card is pivotably mounted to the peripheral wall.

4. A container as recited in claim 1, wherein the information-receiving card is fixedly mounted to the peripheral wall.

5. A container as recited in claim 1, wherein the peripheral wall includes a cut registered with the slot.

6. A container as recited in claim 1, wherein the secondary wall is a first secondary wall and the document-receiving compartment is a first document-receiving compartment; the container further comprising a second secondary wall mounted to the peripheral wall so as to define a second document-receiving compartment therebetween.

7. A container as recited in claim 6, wherein each of the first and second secondary walls having longitudinal ends and including first and second pivotable wings at respective longitudinal ends.

8. A container as recited in claim 7, wherein the peripheral wall includes top and bottom edges and being tapered from the top edge to the bottom edge; the first and second pivotable wings being pivotable between an unfolded position wherein the wings are generally parallel to at least a portion of said peripheral wall to a support position wherein each of the wings defines an acute angle with the peripheral wall; the container being a first container; the wings defining stoppers for a further container when a second container, similar to the first container is inserted therein in a stack arrangement.

9. A container as recited in claim 1, wherein the peripheral wall includes top and bottom edges and is tapered from the top edge to the bottom edge.

10. A container as recited in claim 1, wherein the at least one document is selected from the group consisting of a prescription, insurance and cash receipts, a memo note, a booklet, a leaflet, a drug label and insurance and health-care cards.

11. A container as recited in claim 1, wherein the information is provided directly onto the information-receiving card.

12. A container as recited in claim 1, wherein the information relates to at least one of characteristics of the pharmaceutical care, notes, a piece of paper; a priority of the pharmaceutical care, and a path of the pharmaceutical care.

13. A container as recited in claim 1, wherein at least one of the bottom and a cross-section of the peripheral wall is rectangular.

14. A container as recited in claim 1, wherein at least one of the peripheral wall and bottom is made of a plastic material.

15. A container as recited in claim 1, wherein advertisement is displayed on at least one of the peripheral wall, the secondary wall and the information-receiving card.

16. A container as recited in claim 1, wherein an insertion of a document in the document-receiving compartment and adding information onto the information-receiving card is achieved following a predetermined protocol.

17. A container as recited in claim 1, wherein the peripheral wall includes a cut defining a window therein to define a support for the document with the secondary wall.

18. A container as recited in claim 1, wherein the pharmaceutical care is selected from the group consisting of a drug prescription, a health-related advice and a health-related service.

19. A container as recited in claim 1, wherein the bottom is a transparent bottom to allow inspection of medication inserted in the container to be verified from the bottom.

20. An open-top container for the management of a pharmaceutical care comprising:

a bottom a peripheral wall extending from said bottom;

a secondary wall mounted to the peripheral wall so as to define a document-receiving compartment between the peripheral wall and the secondary wall for receiving at least one document; and an information-receiving card mounted to the peripheral wall for receiving and displaying information thereon;

wherein the information is provided indirectly onto the information-receiving card via an information card mountable to the information-receiving card.

21. A container as recited in claim 20, wherein the information card further includes an information template.

22. A container as recited in claim 20, wherein the information card is secured to the information-receiving card by at least one of a rubber band, a clip, and an adhesive.

23. A container as recited in claim 20, wherein at least one of the information-receiving card and the information card includes color thereon.

* * * * *